US007059380B2

(12) United States Patent
Bennett, III et al.

(10) Patent No.: US 7,059,380 B2
(45) Date of Patent: Jun. 13, 2006

(54) SECTIONAL DOOR PANEL HAVING DECORATIVE COMPONENTS

(75) Inventors: Thomas B. Bennett, III, Wooster, OH (US); Willis J. Mullet, Gulf Breeze, FL (US); James A. Mast, Millersburg, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/766,716

(22) Filed: Jan. 27, 2004

(65) Prior Publication Data

US 2005/0161173 A1 Jul. 28, 2005

(51) Int. Cl.
*E05D 15/16* (2006.01)

(52) U.S. Cl. ..... 160/229.1

(58) Field of Classification Search ..... 160/201, 160/229.1, 232, 235, 236, 207, 213; 52/802.1, 52/309.14, 455, 458
See application file for complete search history.

(56) References Cited

U.S. PATENT DOCUMENTS

| | | | | |
|---|---|---|---|---|
| 3,178,776 | A * | 4/1965 | Stansberry | 52/456 |
| 4,284,119 | A * | 8/1981 | Martin et al. | 160/232 |
| 4,828,004 | A | 5/1989 | Martinez et al. | 160/229.1 |
| 5,002,114 | A * | 3/1991 | Hormann | 160/229.1 |
| 5,509,457 | A * | 4/1996 | Jella | 160/201 |
| 5,562,141 | A | 10/1996 | Mullet et al. | 160/232 |
| 5,598,667 | A | 2/1997 | Dykes | 52/71 |
| 5,626,176 | A | 5/1997 | Lewis et al. | 160/201 |
| 5,709,259 | A | 1/1998 | Lewis et al. | 160/201 |
| 5,937,587 | A | 8/1999 | Zinbarg | 52/3 |
| 5,946,869 | A | 9/1999 | Zinbarg | 52/202 |
| 6,035,919 | A | 3/2000 | Zinbarg | 160/113 |
| 6,059,005 | A | 5/2000 | Zinbarg | 160/90 |
| 6,148,896 | A | 11/2000 | Pinto et al. | 160/229.1 |
| 6,446,695 | B1 * | 9/2002 | Forsland | 160/201 |
| 6,554,048 | B1 * | 4/2003 | Jella | 160/229.1 |
| 6,586,085 | B1 * | 7/2003 | Jella | 428/319.1 |

* cited by examiner

*Primary Examiner*—David Purol
(74) *Attorney, Agent, or Firm*—Renner Kenner Greive Bobak Taylor & Weber

(57) ABSTRACT

A sectional door (20,120) for articulated movement between an open position and a closed position having a plurality of interconnected panels (21, 22, 23; 121, 122, 123, 124), a body portion of the panels spacing a first decorative rail (30A, 31A; 130A, 131A, 132A, 133A) and a second decorative rail (30B, 31B; 130B, 131B, 132B, 133B), projections (64, 65, 66, 67; 172, 173) disposed along the first decorative rail and the second decorative rail, the projections (64, 65, 66, 67; 172, 173) configured to form a pinch resistant interface (61, 62; 161, 162, 163) between the panels during articulation thereof, the body portion having an exterior surface (26, 27; 125, 126, 127, 128), the exterior surfaces being spaced an offset depth (D) from the first decorative rail and the second decorative rail, and decorative components (35, 36, 37, 38, 39, 40; 145, 146, 147, 148) attached to the exterior surface and positioned between the first decorative rail and the second decorative rail, whereby the decorative components are outwardly flush with the first decorative rail and the second decorative rail and the decorative rails do not interfere with the pinch resistant interface.

17 Claims, 11 Drawing Sheets

SECTIONAL DOOR PANEL HAVING DECORATIVE COMPONENTS

TECHNICAL FIELD

The present invention relates generally to sectional door panels having pinch resistant properties, and decorative components attached thereto. More specifically, the present invention relates to specially-configured sectional door panels providing for the attachment of decorative components without affecting the pinch resistant properties of the panels. More particularly, the present invention relates to specially-configured sectional door panels with rail pairs, and exterior surfaces offset from the rail pairs where the decorative components are positioned between the rail pairs.

BACKGROUND ART

Sectional doors have long been employed in both residential structures, and commercial and industrial buildings. Sectional doors save space by retracting above, rather than into, the space they enclose. Decorative components have long been attached to the panels of sectional doors to enhance their aesthetic appearance. These decorative components approximate the appearance of wood trim or molding on the surface of the panels. Such molding or wood trim was originally arranged in various patterned designs on the panels, and the decorative components can be fashioned to reflect those designs.

The decorative components have been attached to panels of sectional doors made of a variety of materials. For example, the decorative components have been glued, screwed, nailed, clamped, or otherwise rigidly fastened to the panels. However, in recent years, panels of sectional doors have also been designed to prevent objects or a user's fingers from being caught or "pinched" between the section-to-section interfaces of the panels. These pinch resistant designs have been successful at eliminating the pinching dangers associated with the section-to-section interfaces during the articulation of sectional doors. Some pinch resistant designs employ panels with contoured projections along the section-to-section interface. These projections minimize the space between the panels at the section-to-section interface throughout the range of motion of the sectional door, and thus effectively reduce their tendency for pinching.

Some other pinch resistant designs employ an L-shaped shield composed of a resilient sheet material that guards the gap between the upper and lower panels of a sectional door. For example, the foot portion of the L-shaped shield is attached to the upper edge of a lower sectional door panel, and the leg portion extends upwardly across the gap between the upper and lower panels. The L-shaped shield prevents objects including a user's fingers from being caught between the upper and lower panels at the section-to-section interface. Nevertheless, such objects can still be caught between the L-shaped shield and the upper panel.

Still other pinch resistant designs employ a flexible cover piece. The flexible cover piece is attached at either of its ends to the surfaces of the upper and lower panels of a sectional door by various connectors. These connectors are adapted to hold the flexible cover piece taut when the sectional door is in either the open or closed position. The flexible cover piece prevents objects from being caught between the panels at the section-to-section interface by effectively covering all of the section-to-section interfaces. Ideally, the flexible cover piece must be made of a rather flexible material so it can stretch as the sectional door articulates. However, if the flexible cover piece does not possess the required flexibility, it will bind the movement of the sectional door, and if the flexible cover piece is too flexible, it will ultimately sag. Furthermore, in the event of a storm, the flexible cover piece must be removed to prevent it from becoming damaged.

However complex these designs have become, they are nonetheless silent in addressing the dangers posed by the addition of decorative components to the panels. Like the pieces, the decorative components abutting one another along the section-to-section interface of the panels also pose a pinching danger. As a result, rather than using decorative components, the aforementioned patterned designs have been shaped directly into the panels themselves. The addition of the patterned designs to the panels themselves allows the pinch resistance embodied in the panels to be maintained. Furthermore, some of these sectional door designs provide for limited alteration of the patterned designs by allowing the aforementioned shaped panels to be rearranged. However, the use of patterned designs shaped directly into the panels themselves does not permit a manufacturer, or, for that matter, a consumer to substantially alter the appearance of the sectional door from time to time by adding, subtracting, or rearranging decorative components. Nevertheless, partially shaped, specially-configured sectional door panels can provide the required flexibility to add, subtract, or rearrange decorative components without affecting the pinch resistant properties of the panels.

Therefore, there is a need for specially-configured panels allowing decorative components to be attached in various patterns on the panels without presenting an additional pinch hazard to effectively maintain the pinch resistance embodied in the panels themselves.

DISCLOSURE OF THE INVENTION

Accordingly, an object of the present invention is to provide a sectional overhead door which has raised decorative elements on the exterior surface that do not present an additional pinch hazard between panels during opening and closing of the door. Another object of the invention is to provide such a door having upstanding rails relative to the exterior surface at the panel interfaces without changing the pinch resistant characteristics of the panel interface profiles. A further object of the invention is to provide such a door that does not require a gap or space between the sections to compensate for the presence of decorative rails at the panel interfaces.

Another object of the present invention is to provide a sectional overhead door wherein the decorative rail components are formed integrally with the panel profile such that only decorative stiles and/or diagonal components need to be attached to the exterior surface of the panels. Yet another object of the invention is to provide such a door that permits easy attachment of the stiles and other decorative components to the panels with any of a variety of fastener mechanisms. A further object of the invention is to provide such a door where the fastener mechanisms permit the easy replacement of damaged or deteriorated decorative components and the alteration of the position of the decorative trim components to change the appearance of the door, if desired.

Still another object of the present invention is to provide a sectional overhead door that is less costly due to the raised rails being formed integrally with the body portion of the panels. Yet another object of the invention is to provide such a door that may have the stiles and other decorative components constructed of different materials than the panel body to resist deterioration, reduce overall weight of the door and/or provide an overall lower cost decorative door. Still a further object of the present invention is to provide such a door that is interchangeable with a conventional door in its ability to operate on the conventional track system.

In general, the present invention contemplates a sectional door for articulated movement between an open position and a closed position having a plurality of interconnected panels, a body portion of the panels spacing a first decorative rail and a second decorative rail, projections disposed along the first decorative rail and the second decoration rail, the projections configured to form a pinch resistant interface between the panels during articulation thereof, the body portion having an exterior surface, the exterior surface being spaced an offset depth from the first decorative rail and the second decorative rail, and decorative components attached to the exterior surface of the panels and positioned between the first decorative rail and the second decorative rail, whereby the decorative components are outwardly flush with the first decorative rail and the second decorative rail and the decorative rails do not interfere with the pinch resistant interface.

BEST MODE FOR CARRYING OUT THE INVENTION

Figure 1:
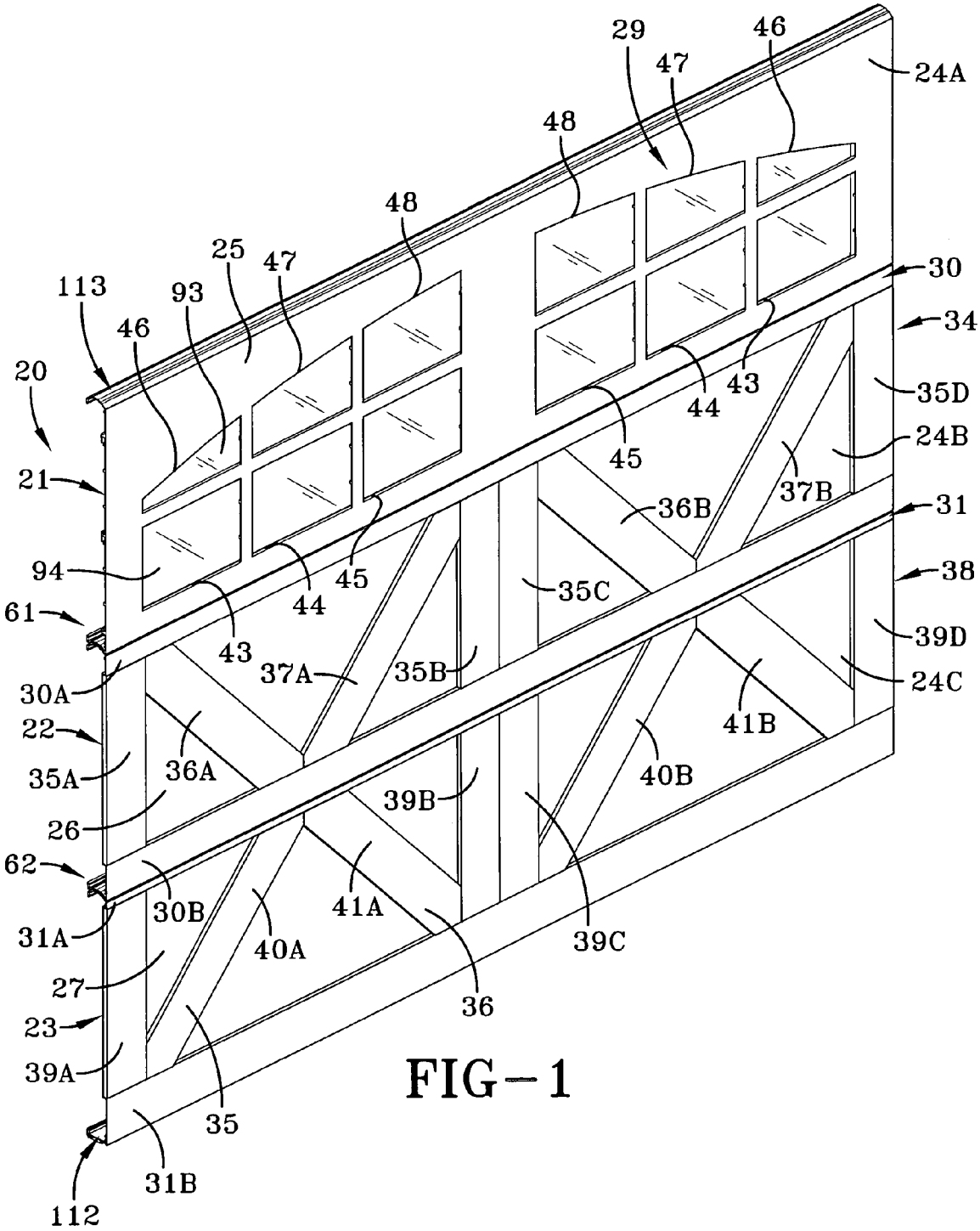
FIG. 1 is a perspective view of a sectional door embodying the concepts of the present invention.

A sectional door according to the concepts of the present invention is generally indicated by the numeral 20. In the first embodiment, the sectional door 20 is composed of three uninsulated panels including an upper panel, generally indicated by the numeral 21, intermediate panel, generally indicated by the numeral 22, and a lower panel, generally indicated by the numeral 23. The sectional door 20 will generally be constructed of a plurality of panels ranging from two to six panels depending on the application. Furthermore, the panels 21, 22, and 23 of the first embodiment are constructed of metallic materials (such as steel or aluminum), but can also be constructed of non-metallic materials (such as wood or plastic).

Referring to FIG. 1 of the drawings, the sectional door 20 will be placed in an opening for articulated movement between opened and closed positions. To that end, abutting panels will be hinged to one another, and each of the panels 21, 22, and 23 will be provided with rollers (not shown). These rollers will be positioned in substantially L-shaped tracks (not shown) to facilitate the opening and closing of the sectional door 20 as is well known in the art. As such, the panels 21, 22, and 23 are configured to provide the "Carriage-House" look desired by costumers, and be interchangeable with standard sectional door panels.

As shown, the intermediate panel 22 and the lower panel 23 each have similar body portions 24B and 24C having exterior surfaces 26 and 27, respectively, and the upper panel 21 has a body portion 24A having an exterior surface 25 incorporating a window pattern, generally indicated by the numeral 29. The exterior surfaces 26 and 27 are offset from rail pairs 30 and 31, respectively. The rail pairs 30 and 31 are respectively integral with the intermediate panel 22 and lower panel 23, and are disposed near the panel-to-panel interfaces. For example, individual rails 30A and 30B of rail pair 30 respectively run along the upper and lower extremities of the intermediate panel 22 and are effectively spaced by exterior surface 26. Furthermore, individual rails 31A and 31B of rail pair 31 respectively run along the upper and lower extremities of the lower panel 23 and are effectively spaced by the exterior surface 27.

When using metallic materials for the panels 22 and 23, the roll former used to respectively form the rail pairs 30 and 31 can be adjusted to vary the width of the individual rails, and therefore, vary the distance between the individual rails to provide different appearances. As such, adjustment of the roll former can be used to provide each panel with a unique appearance. Furthermore, when the panels 22 and 23 (either metallic or non-metallic) are formed by extrusion, the extrusion dies can also be adjusted to vary the width of and the distance between the individual rails.

Because exterior surfaces 26 and 27 are offset from the respective rail pairs 30 and 31, various stiles or other decorative components can be added in accordance with the present invention to the exterior surfaces 26 and 27, while still maintaining an outwardly flush position and appearance with respect to rails pairs 30 and 31. In other words, the depth D of the offset of the exterior surfaces 26 and 27 from their respective rail pairs 30 and 31 is equal to the thickness of the various decorative components. (FIGS. 3, 4 and 6,7)

As seen in FIG. 1, the various decorative components (or stiles) are attached in a predetermined pattern to the exterior surfaces 26 and 27. For example, set of decorative components, generally indicated by the numeral 34, are attached to exterior surface 26, and consists of vertical components 35A, 35B, 35C, 35D, first diagonal components 36A, 36B, and second diagonal components 37A, 37B. Similarly, a set of decorative components, generally indicated by the numeral 38, are attached to exterior surface 27, and consists of vertical components 39A, 39B, 39C, 39D, first diagonal components 40A, 40B, and second diagonal components 41A, 41B.

Figure 6:
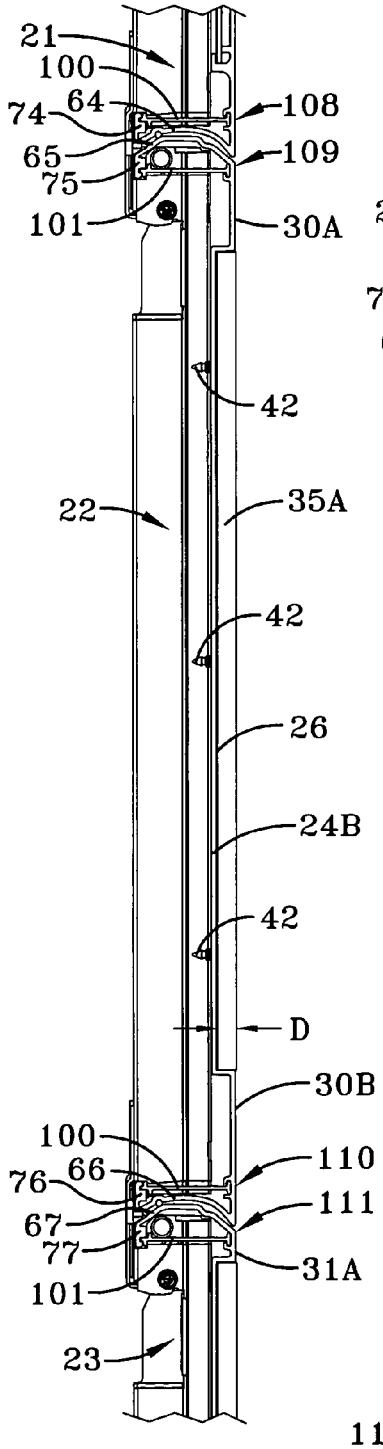
FIG. 6 is an end elevational view of the intermediate sectional door panel of FIG. 1 including the interfaces with the upper and lower sectional door panels.
Figure 7:
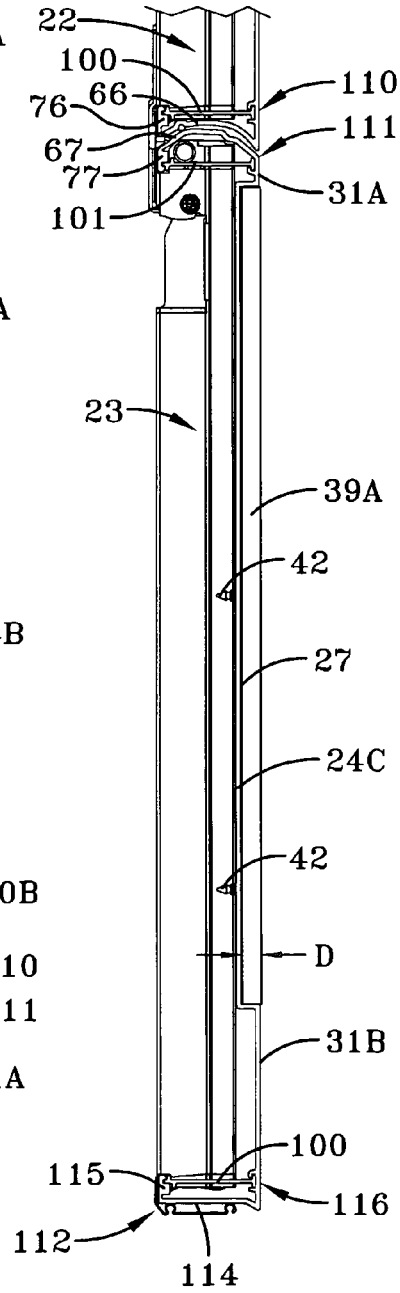
FIG. 7 is an end elevational view of the lower sectional door panel of FIG. 1 including the interface with the intermediate sectional door panel.

The various stiles or other decorative components are attached to the exterior surfaces 26 and 27 using a fastening mechanism employing either mechanical fasteners (such as screws or nails) or adhesives. For example, as seen in FIGS. 2A, 6 and 7, screws 42 are provided to attach vertical component 35D to the exterior surface 26. Furthermore, these decorative components can be made from metallic materials (such as steel or aluminum), or non-metallic materials (such as wood or plastic). However, if the panels 22 and 23, and the various decorative components are constructed of different materials, then the vertical length of the decorative components may need to be adjusted to compensate for unequal thermal expansion with temperature change. In other words, the decorative components will have a slightly shorter vertical length than the distance between the rail pairs 30 and 31 depending on the materials used for construction. For example, if the panels 22 and 23 are constructed of steel with a coefficient of thermal expansion of approximately $6.0\times10^{-5}$ in/in/° F., and the decorative components are constructed from polyvinylchloride (PVC) with a coefficient of thermal expansion of $29.5\times10^{-5}$ in/in/° F., then the vertical length of the decorative components must be adjusted to compensate for the greater coefficient of thermal expansion of the PVC components.

Figure 2:
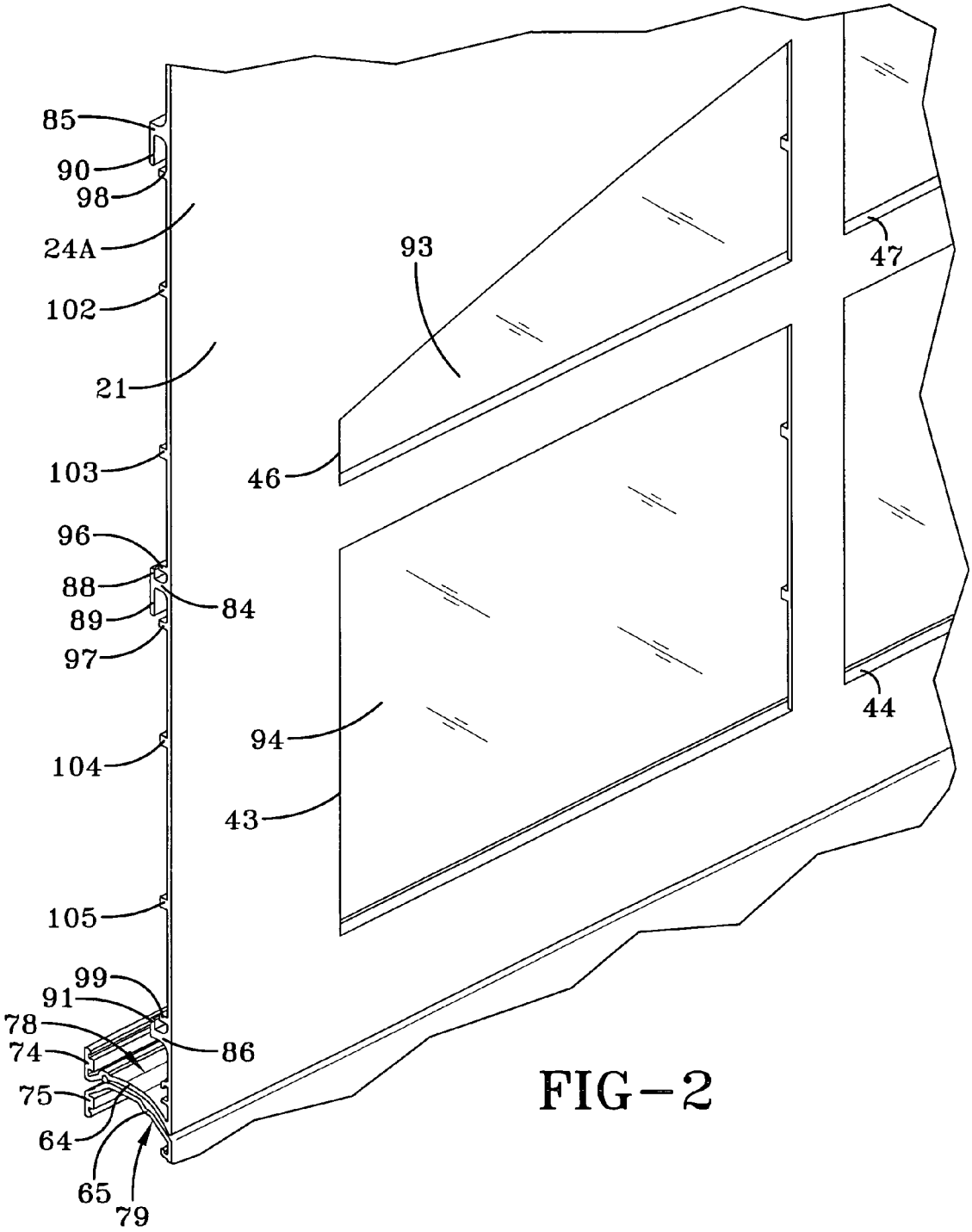
FIG. 2 is an enlarged fragmentary perspective view of the exterior of the upper sectional door panel of FIG. 1.
Figure 2A:
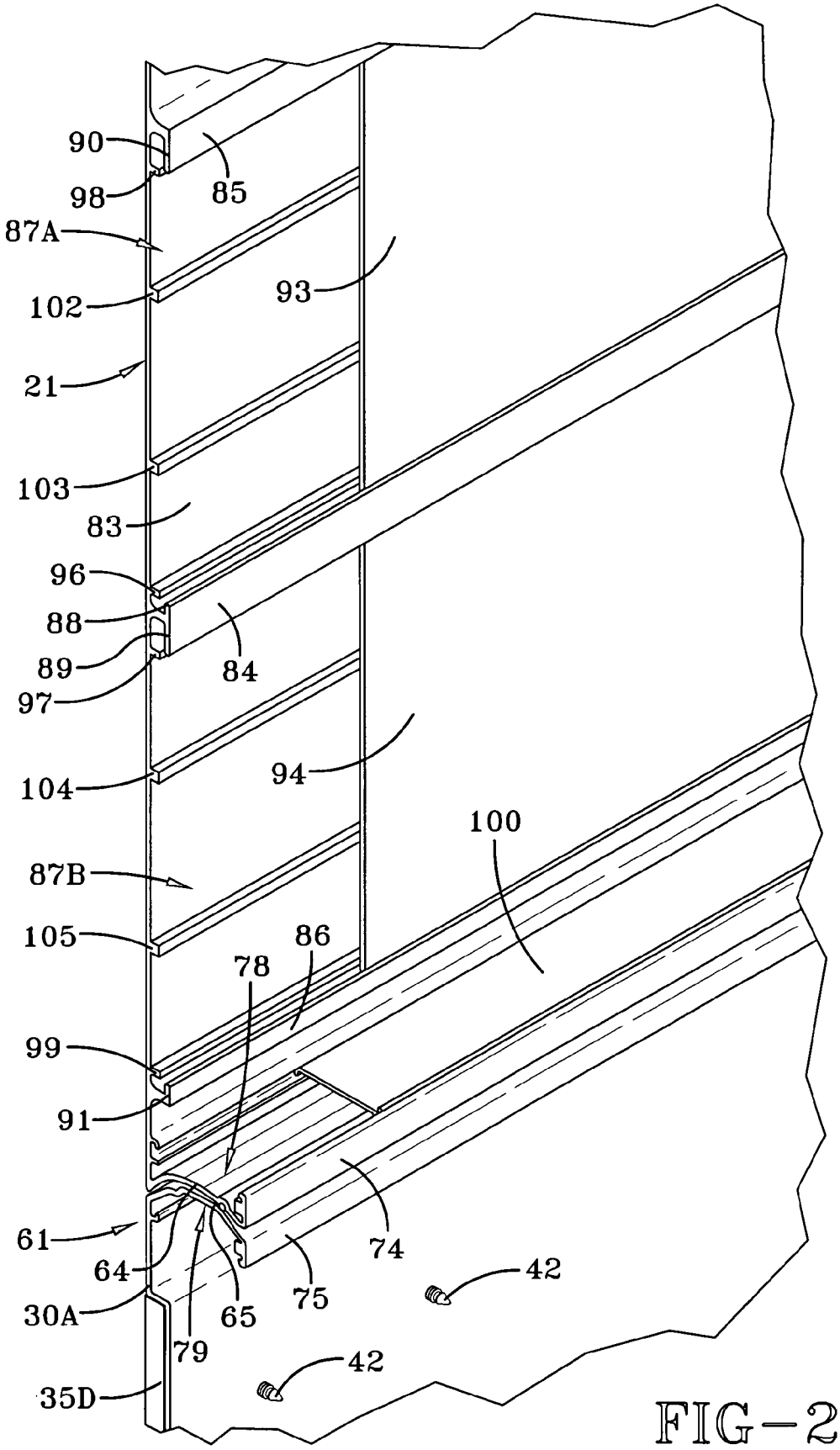
FIG. 2A is an enlarged fragmentary perspective view of the interior of the upper sectional door panel of FIG. 1.
Figure 3:
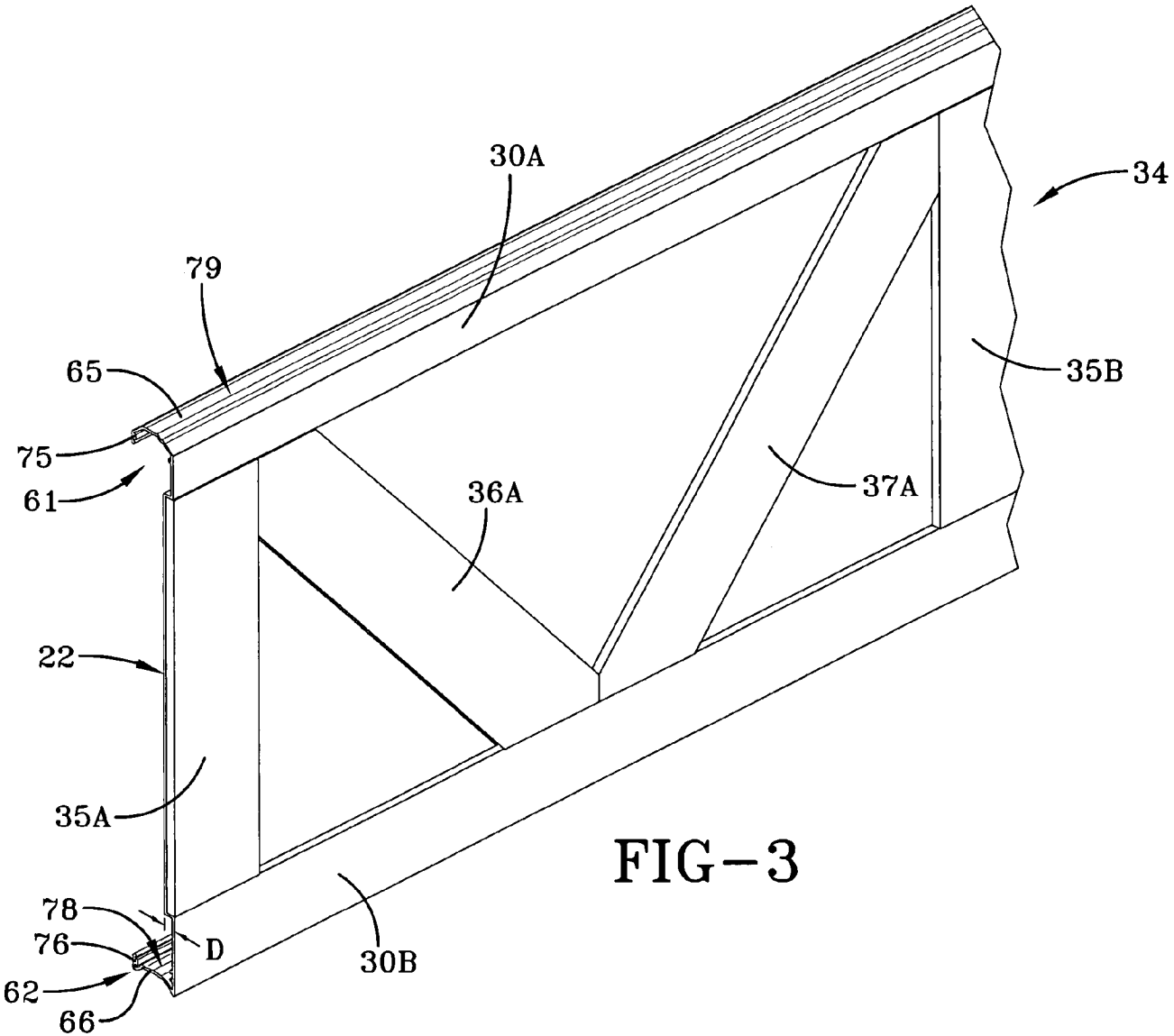
FIG. 3 is an enlarged fragmentary perspective view of the exterior of the intermediate sectional door panel of FIG. 1.
Figure 4:
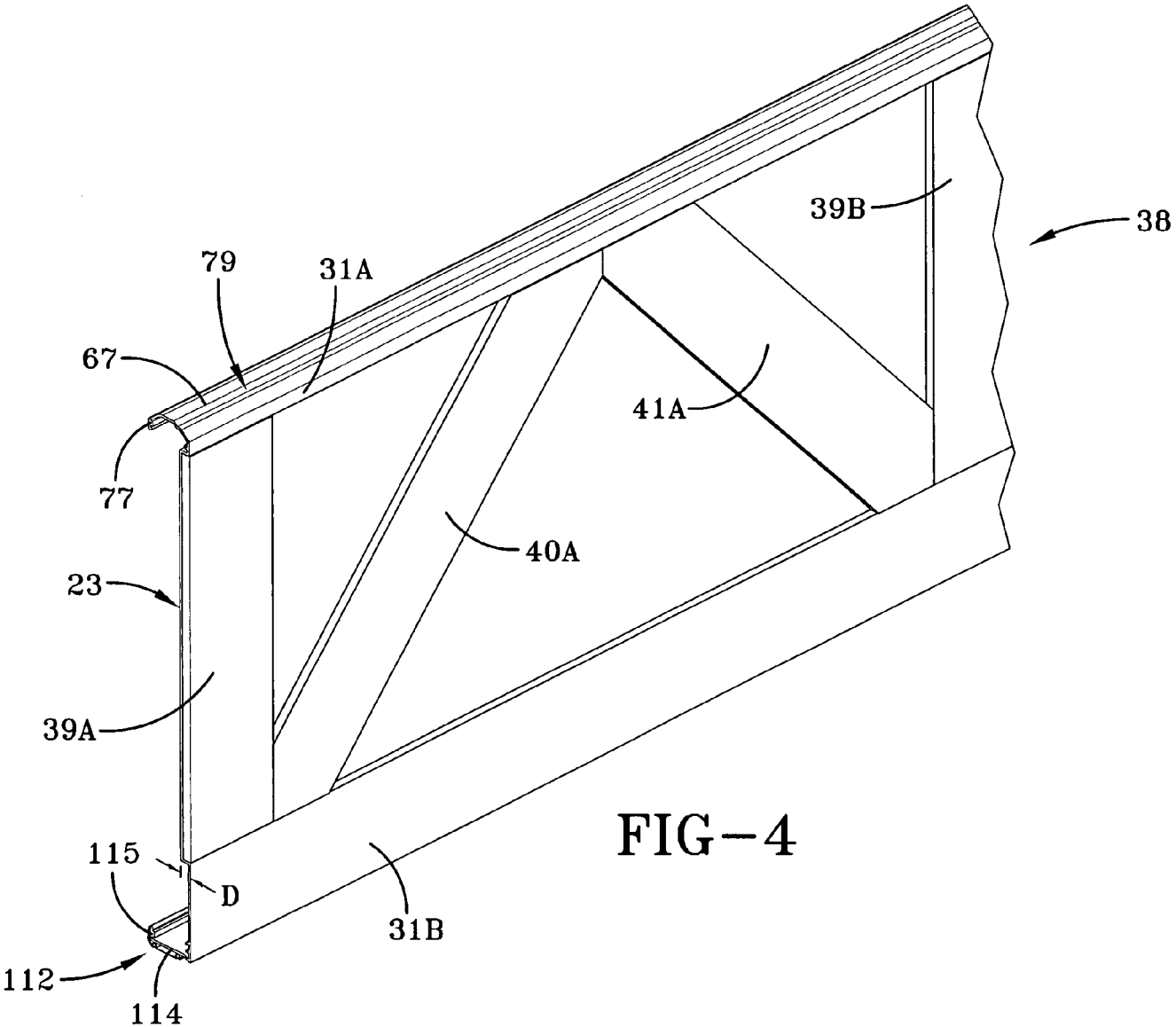
FIG. 4 is an enlarged fragmentary perspective view of the exterior of the lower sectional door panel of FIG. 1.

As seen in FIGS. 2, 3 and 4, the offset relationship of the rail pairs 30 and 31 with respect to the exterior surfaces 26 and 27 enable the pinch resistant properties of the various panel-to-panel interfaces 61 and 62 to be maintained. The pinch resistant panel to panel interfaces 61 and 62 are formed by providing the upper panel 21, intermediate panel 22, and lower panel 23 with pinch resistant characteristics along these interfaces. For example, both pinch resistant interfaces 61 and 62 are respectively formed by opposing concave projections 64, 66 and convex projections 65, 67.

The concave projections 64, 66 respectively depend from the lower extremities of the upper panel 21 and intermediate panel 22, and the convex projections 65, 67 respectively depend from the upper extremities of the intermediate panel 22 and the lower panel 23. More specifically, the concave projection 64 extends along the lower extremity of the upper panel 21, and the concave projection 66 extends along the lower extremity of the rail 30B of the intermediate panel 22. Furthermore, the convex projection 65 extends along the upper extremity of the rail 30A of the intermediate panel 22, and the convex projection 67 extends along the upper extremity of the rail 31A of the lower panel 23.

When the panels 21, 22, and 23 are properly aligned, the concave projection 64 abuts the convex projection 65, and the concave projection 66 abuts the convex projection 67. Therefore, as the sectional door 20 articulates between the opened and closed positions, the proximity of the concave projections 64, 66 to the convex projections 65, 67, respectively, prevents objects or a user's fingers from being caught in the panel-to-panel interfaces. Therefore, the various sets of decorative components 34 and 38 can be attached to their respective panels without affecting the performance of the pinch resistant panel to panel interfaces 61 and 62.

To add strength to the concave projections 64, 66 and convex projections 65, 67, upturned lips 74, 76 are added to the distal ends of the concave projections 64, 66, and downturned lips 75, 77 are added to the distal end of the convex projections 65, 67. Furthermore, the concave projections 64, 66 and convex projections 65, 67 are periodically crimped along their respective longitudinal surfaces. In has been found that such periodic crimping, as generally indicated by the numeral 78, on the concave projections and numeral 79 on the convex projections further reinforces the concave and convex projections.

Figure 5:
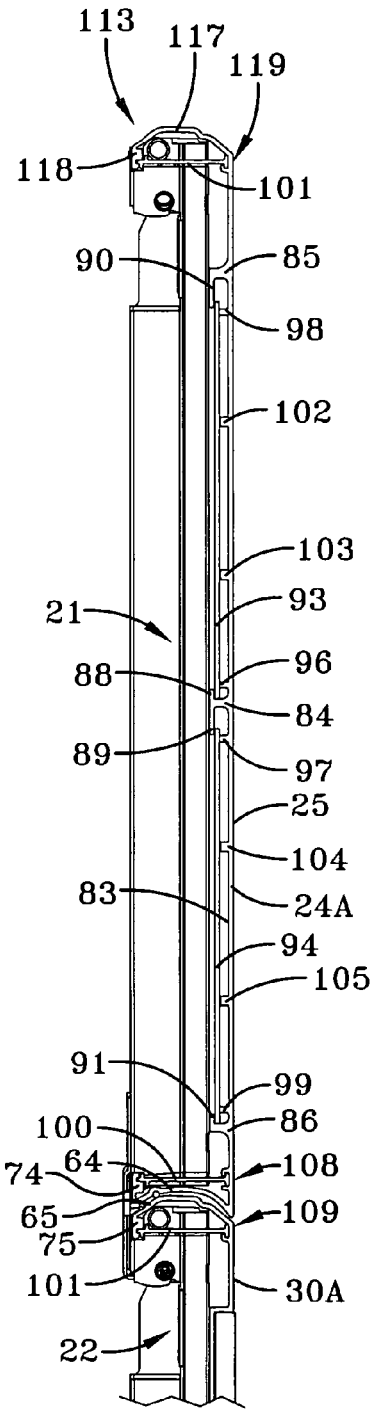
FIG. 5 is an end elevational view of the upper sectional door panel of FIG. 1 including the interface with the intermediate sectional door panel.

If necessary, the concave projections 64,66 and convex projections 65, 67 can be further strengthened by reinforcing strips 100, 101. As seen in FIG. 7, these reinforcing strips 100, 101 are respectively positioned behind the concave projections 64, 66 and convex projections 65, 67, and reinforce these projections along their longitudinal lengths. To illustrate, the reinforcing strip 100 (FIG. 2A) is positioned along the longitudinal length of the concave projection 64. As seen in FIGS. 5 and 6, the reinforcing strips 100, 101 positioned behind the concave projection 64 and behind the convex projection 65 are respectively held in position by opposed grooves 108 on the bottom extremity of the upper panel 21 and by opposed grooves 109 on the upper extremity of the intermediate panel 22. Furthermore, as seen in FIGS. 6 and 7, the reinforcing strips 100, 101 positioned behind the concave projection 66 and behind the convex projection 67 are respectively held in position by opposed grooves 110 on the bottom extremity of the intermediate panel 22 and by opposed grooves 111 on the upper extremity of the lower panel 23.

Like the reinforcing strips 100, 101, the opposed grooves 108, 109, 110, 111 extend along the longitudinal lengths of their respective panels 21, 22, and 23. The opposed grooves 108, 109, 110, 111 each include two grooves. The two grooves are spaced apart by the horizontal width of the concave projections 64, 66 or convex projections 65, 67. Using the bottom extremity of the upper panel 21 to illustrate, one of the two grooves is provided on the interior surface 83, and the other of the two grooves is provided on the upturned lip 74. Ultimately, the reinforcing strips 100, 101 are oriented horizontally with their edges inserted into the two grooves, thereby reinforcing the concave projections 64, 66 and convex projections 65, 67.

In addition, as seen in FIGS. 5 and 7, reinforcing strips 100, 101 can respectively be provided along the lower edge 112 of the lower panel 23, and along the upper edge 113 of the upper panel 21. For example, the lower edge 112 is L-shaped, and is formed from a flat projection 114, and an upturned lip 115. The flat projection 114 extends along the along the lower extremity of the rail 31B of the lower panel 23. As seen in FIG. 7, the flat projection 114 spaces the upturned lip 115 from the interior surface of the rail 31B. The reinforcing strip 100 is positioned above the flat projection 114, and is held in position using opposed grooves 116. The opposed grooves 116 include two grooves: one provided on the interior surface of the rail 31B, and one provided on the upturned lip 115.

The upper edge 113 is partially convex-shaped, and is formed from a convex projection 117 and a downturned lip 118. The convex projection 117 extends along the upper extremity of the upper panel 21, and, as seen in FIG. 5, the convex projection 117 spaces the downturned lip 118 from the interior surface 83. The reinforcing strip 101 is held in position using opposed grooves 119. The opposed grooves 119 include two grooves: one provided on the interior surface 83 and one provided on the downturned lip 118.

To provide the window pattern 29, various apertures are provided in the upper panel 21. As seen in FIG. 1, there are three matching rectangular holes 43, 44, and 45 on the right and left sides of the upper panel 21. Furthermore, for every matching rectangular hole 43, 44, and 45 there are accompanying specially-shaped holes 46, 47, and 48. Provided behind the rectangular holes 43, 44, and 45, and the specially-shaped holes 46, 47, and 48 are glazing (or top light) sheets 93, 94. These sheets 93, 94 are attached to the upper panel 21 via various clips provided on the interior surface 83 of the upper panel 21. For example, center clip 84 runs along the longitudinal length of the interior surface 83 (FIG. 2A). The center clip 84 effectively bisects the upper panel 21 into an upper half 87A and lower half 87B. On either side of the center clip 84, first and second opposing clips 85 and 86 also run along the longitudinal length of upper panel 21 and are, respectively, provided on the upper half 87A and lower half 87B. The center clip 84 is provided with two pinching arms 88, 89, and the first and second opposing clips 85 and 86 are provided with pinching arms 90 and 91, respectively. In addition, provided adjacent the pinching arms 88, 89 are pinching ribs 96, 97, and adjacent the pinching arms 90 and 91 are pinching ribs 98 and 99, respectively.

For proper positioning, the sheet 93 is initially inserted between the pinching arm 88 and pinching rib 96, and pinching arm 90 and pinching rib 98 at either the right or left ends of the panel 21. Likewise, to properly position, the sheet 94 is inserted between pinching arm 89 and pinching rib 97, and pinching arm 91 and pinching rib 99 at either the right or left ends of the panel 21. After the initial insertion, the sheets 93 and 94 are slid down the longitudinal length of the panel 21 into place in their respective retaining structures. In addition, spaced supporting ribs 102, 103 and 104, 105 are also respectively provided on the upper half 87A and lower half 89B. Except for interruptions caused by the matching rectangular holes 43, 44, and 44 and the matching specially-shaped holes 46, 47, and 48, the spaced supporting ribs extend along the longitudinal length of panel 21. These spaced supporting ribs 102, 103 and 104, 105 provide additional support for the sheets 93 and 94, and prevent these sheets from rattling within their retaining structures due to door movement, wind or other environmental conditions.

Figure 8:
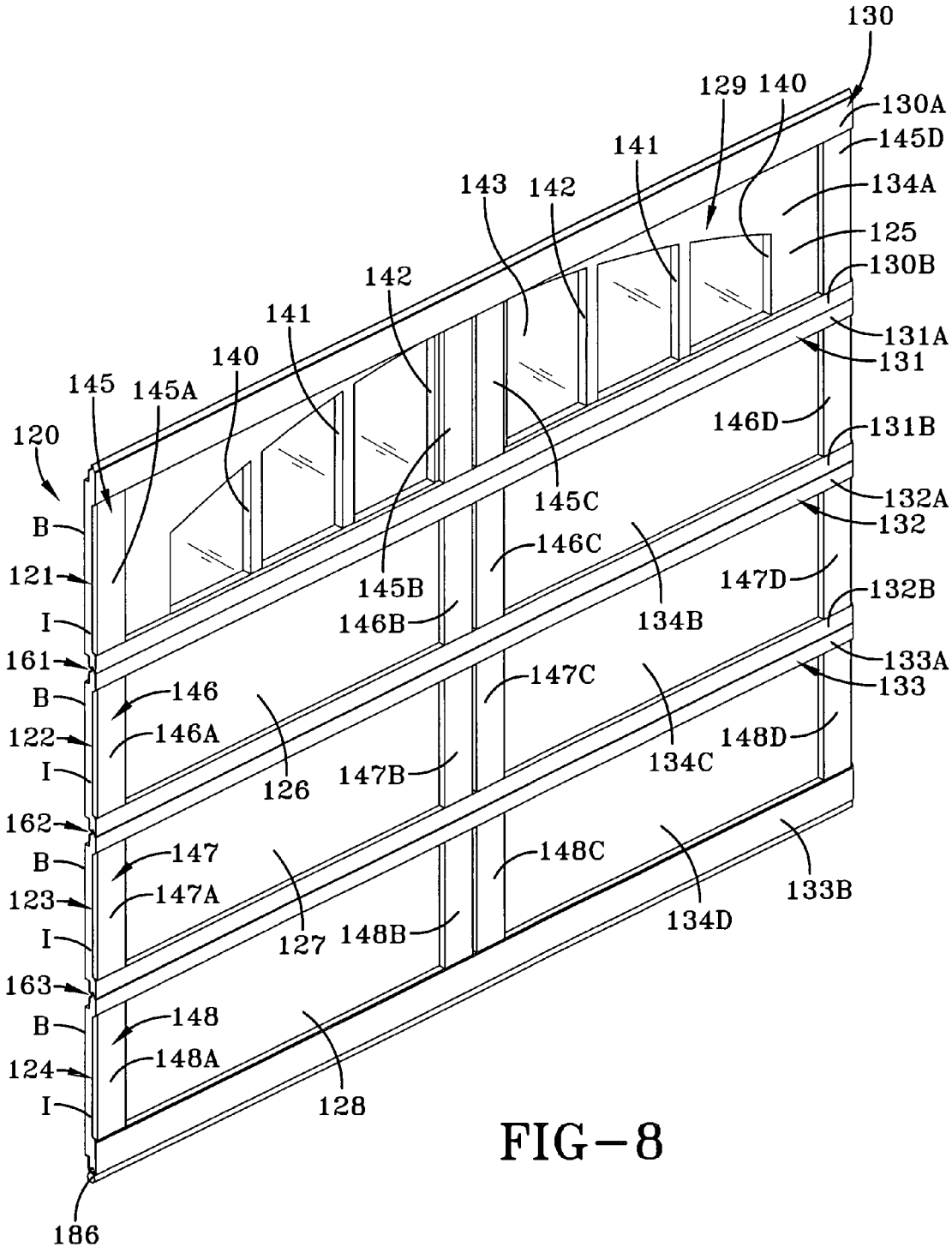
FIG. 8 is a perspective view of an insulated sectional door constituting a second embodiment of the present invention.

As seen in FIG. 8, a second sectional door embodiment according to the concepts of the present invention is generally indicated by the numeral 120. The sectional door 120 is composed of four foam filled panels including an upper panel 121, a first intermediate panel 122, a second intermediate panel 123, and a lower panel 124 for articulating movement between an opened and closed position as is well known in the art. The foam filled panels are formed by sandwiching insulation between sheets of metallic (such as steel or aluminum) or non-metallic (such as plastic or wood) materials or combinations. For example, the insulation I is preferably either foam plastic blocks or foam plastic foamed in situ located between body portions 134A, 134B, 134C and 134D and backers B for the panels 121, 122, 123 and 124. Furthermore, when using foamed plastic applied between the sheets, the reduction of insulation due to the unique shape of the panels does not significantly effect panel strength.

Referring to FIG. 8 of the drawings, the sectional door 120 will be placed in an opening for articulated movement between opened and closed positions. To that end, abutting panels will be hinged to one another, and each of the panels 121, 122, 123, and 124 will be provided with rollers (not shown). These rollers will be positioned in substantially L-shaped tracks (not shown) to facilitate the opening and the closing of the sectional door 120 as is well known in the art. As such, the panels 121, 122, 123, and 124 are configured to provide the "Carriage-House" look desired by costumers, and be interchangeable with standard sectional door panels.

Figure 9:
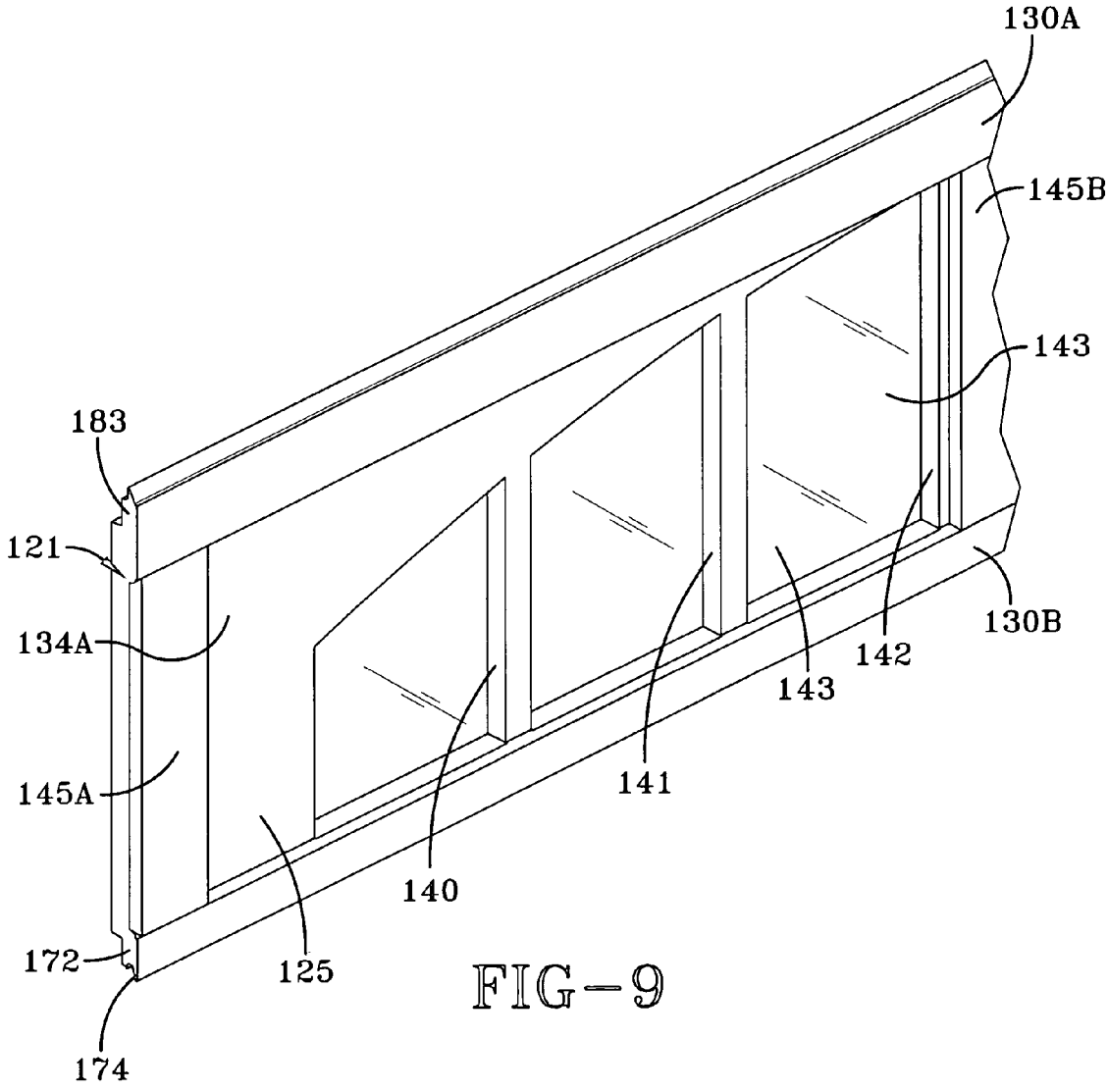
FIG. 9 is an enlarged fragmentary perspective view of the exterior of the upper sectional door panel of FIG. 8.
Figure 10:
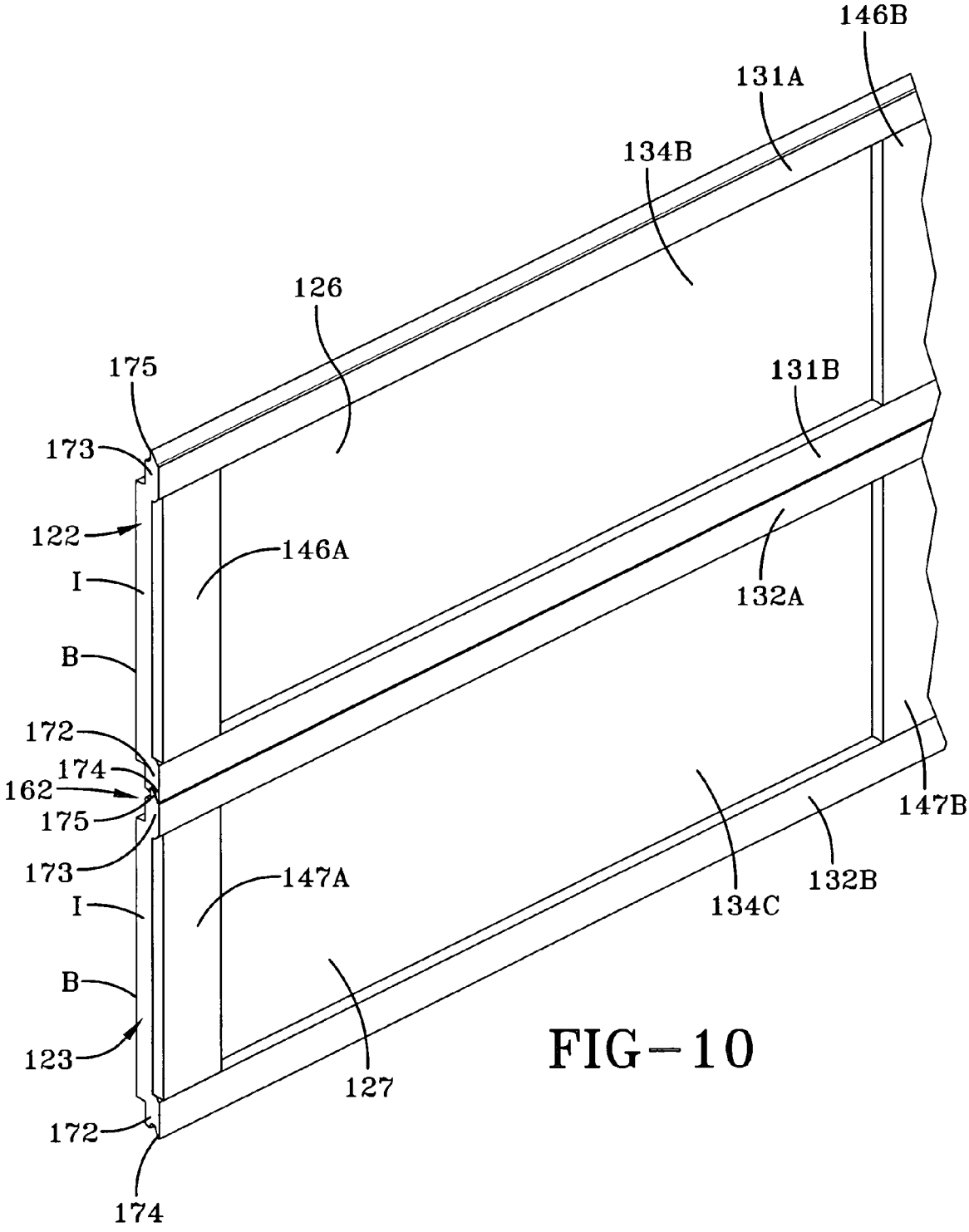
FIG. 10 is an enlarged fragmentary perspective view of the exteriors of the first and second intermediate sectional door panels of FIG. 8.

As seen in FIGS. 8–10, the first intermediate panel 122, the second intermediate panel 123, and the lower panel 124 each have similar body portions 134B, 134C, and 134D having exterior surfaces 126, 127, and 128, respectively, and the upper panel 121 has a body portion 134A having an exterior surface 125 incorporating a window pattern generally indicated by the numeral 129. The window pattern 129 is incorporated into the body portion 134A by providing various matching holes 140, 141, and 142 on the right and left sides or halves of the upper panel 121. Provided between the matching holes 140, 141, and 142 are glazing or top light sheets 143. Alternately, glazing (or top light) sheets can be press-fit or glued into the matching holes 140, 141, and 142.

As seen in FIGS. 8–12, the exterior surfaces 125, 126, 127, 128 are offset from rail pairs 130, 131, 132, and 133. These rail pairs 130, 131, 132, and 133 are respectively integral with the upper panel 121, first intermediate panel 122, second intermediate panel 123, and lower panel 124, and are disposed along the upper and lower extremities of their respective panels. For example, rail pair 130 is composed of upper rail 130A and lower rail 130B disposed along the upper and lower extremities of upper panel 121, respectively. Likewise, rail pairs 131, 132, and 133 are composed of upper rails 131A, 132A, and 133A, and lower rails 131B, 132B, and 133B, respectively, and are disposed along the upper and lower extremities of their respective panels.

Because exterior surfaces 125, 126, 127 and 128 are offset from their respective rail pairs 130, 131, 132, and 133, these rail pairs define a space on the exterior surfaces of their respective panels where decorative components can be attached. As a result, various decorative components are attached in accordance with the present invention to the exterior surfaces 125, 126, 127, and 128 while still maintaining a flush appearance with respect to the rails pairs 130, 131, 132, and 133. In other words, the depth D of the offset of the exterior surfaces 125, 126, 127 and 128 from their respective rails is equal to the thickness of the various decorative components (FIGS. 11–13).

As seen in FIG. 8, various decorative components (or stiles) are attached in a specified pattern to the exterior surfaces 125, 126, 127 and 128. The decorative components are sets of vertical components 145, 146, 147, and 148. Set 145 is composed of individual components 145A, 145B, 145C, and 145D, set 146 is composed of individual components 146A, 146B, 146C, and 146D, set 147 is composed of individual components 147A, 147B, 147C, and 147D, and set 148 is composed of individual components 148A, 148B, 148C, and 148D. The sets of vertical components 145, 146, 147, and 148 are positioned between rail pairs 130, 131, 132, and 133 on their respective exterior surfaces 125, 126, 127, and 128 in a prearranged pattern. However, these sets of vertical components can ultimately be arranged to a user's preference.

The various stiles or other decorative components are attached to the exterior surfaces 125, 126, 127, and 128 using a fastening mechanism employing mechanical fasteners (such as screws or nails) or adhesives. Like the first embodiment, these decorative components can be made from metallic materials (such as steel or aluminum), or non-metallic materials (such as wood or plastic). However, as described hereinabove, if the decorative components are constructed of different materials than the panels, then the vertical length of the decorative components may need to be adjusted to compensate for unequal thermal expansion with temperature change, as described hereinabove in conjunction with the first embodiment of the invention.

Figure 11:
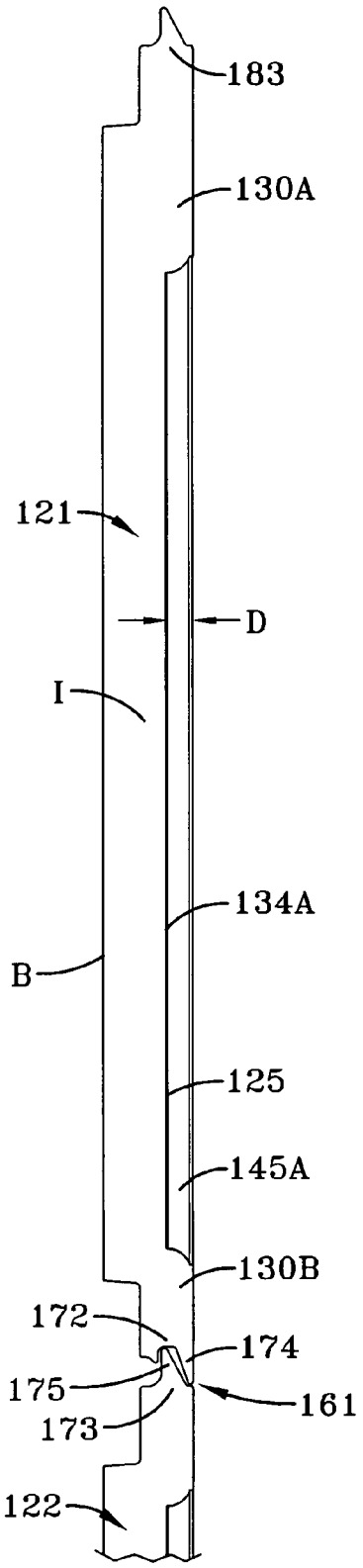
FIG. 11 is an end elevational view of the upper panel of FIG. 8 and the interface between the upper and first intermediate sectional door panels.
Figure 12:
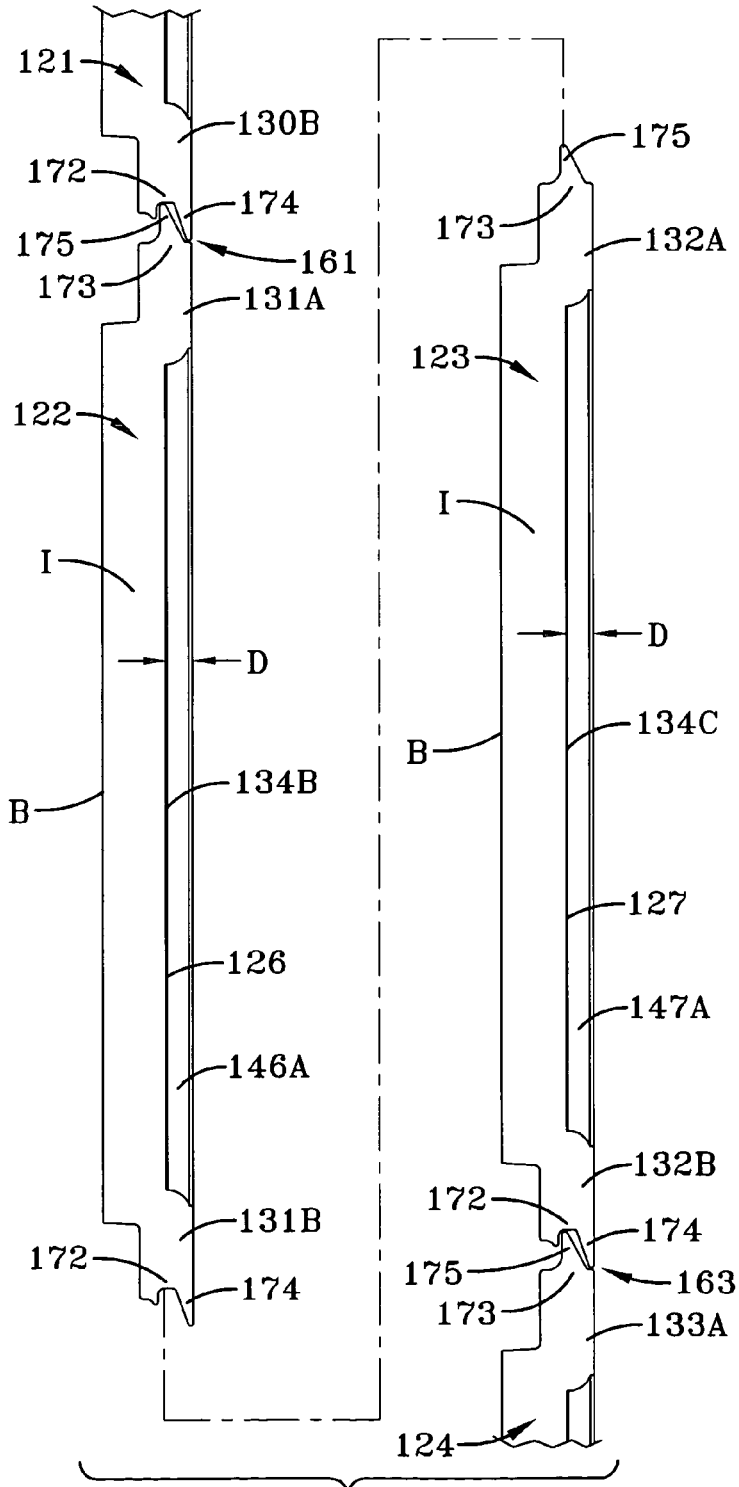
FIG. 12 is an end elevational view of the first and second intermediate panels of FIG. 8 and the interface between the first and second intermediate panels.
Figure 13:
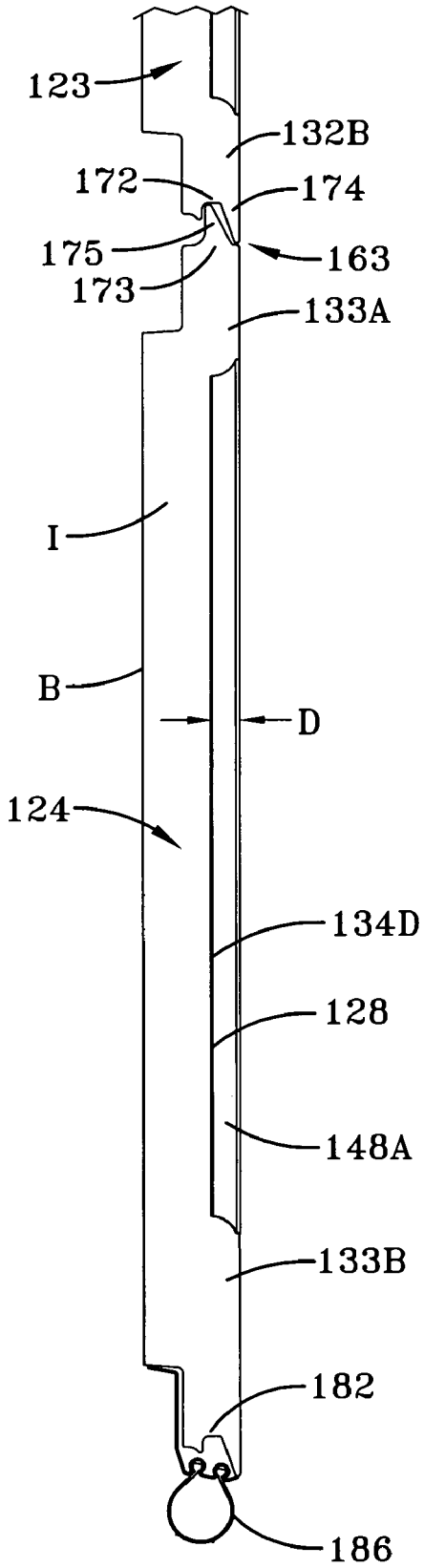
FIG. 13 is an end elevational view of the lower panels of FIG. 8 and the interface between the second intermediate and lower sectional door panels.

As seen best in FIGS. 11 and 12, the placement of the various sets of vertical components between the rail pairs 130, 131, 132, and 133 allows the pinch resistant properties of the various panel to panel interfaces 161, 162, and 163 to be maintained. For example, the various panels are provided with pinch resistant projections that prevent objects or a user's fingers from being pinched as the sectional door 120 articulates between opened and closed positions. For example, the pinch resistant panel to panel interface 161 is provided where the bottom extremity of the upper panel 121 abuts the top extremity of the first intermediate panel 122. As part of the interface 161, the bottom extremity of the upper panel 121 incorporates a bottom projection 172 and the top extremity of panel 122 incorporates a top projection 173. The bottom projection 172 and the top projection 173 have projecting fingers 174 and 175, respectively. As seen in FIGS. 11–13, the projecting finger 174 is positioned in front of the projecting finger 175 relative to the exterior surfaces of the panels.

Furthermore, the pinch resistant panel to panel interfaces 162 and 163 are respectively provided where the bottom extremity of the first intermediate panel 122 abuts the top extremity of the second intermediate panel 123, and where the bottom extremity of the second intermediate panel 123 abuts the top extremity of lower panel 124. Like the interface 161, the interface 162 incorporates a bottom projection 172, including a projecting finger 174 along the bottom extremity of first intermediate panel 122, and incorporates a top projection 173, including a projecting finger 175 along the top extremity of second intermediate panel 123. Again, like the interface 161, the interface 163 incorporates a bottom projection 172, including a projecting finger 174 along the bottom extremity of second intermediate panel 123, and incorporates a top projection 173, including a projecting finger 175 along the top extremity of lower panel 124.

The projecting fingers 174 and 175 enable the pinch resistant panel to panel interfaces 161, 162, and 163 to function. For example, as the sectional door 120 is articulated between the opened and closed positions, the proximity and configuration of the projecting finger 174 and 175 in relation to one another prevents a user's fingers or other objects from being pinched between the projections 172 and 173. Therefore, the various sets of decorative components 145, 146, and 147 can be attached to their respective panels without affecting the performance of the pinch resistant panel to panel interfaces 161, 162, and 163.

Additionally, the bottom projection 182 of the bottom panel 124, and the top projection 183 of the upper panel 121 are respectively identical to the bottom projection 172 and top projection 173 without adversely effecting the operation of the sectional door 120. For example, the bottom projection 182 can be capped with an elastomeric impact and sealing astragal 186 which engages the floor or ground when the sectional door 120 is in the closed position. As such, separate tooling is unnecessary to manufacture the various panels 121, 122, 123, and 124, and these panels can be interchanged without compromising the pinch resistant panel to panel interfaces 161, 162, and 163.

Thus, it should be evident that the sectional door embodiments disclosed herein carry out one or more of the objects of the present invention set forth above and otherwise constitute an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A sectional door for articulated movement between an open position and a closed position comprising, a plurality of interconnected panels, a body portion of said panels spacing a first decorative rail and a second decorative rail, projections disposed along said first decorative rail and said second decorative rail, said projections configured to form a pinch resistant interface between said panels during articulation thereof, said body portion having an exterior surface, said exterior surface being spaced an offset depth from said first decorative rail and said second decorative rail, and decorative components attached to said exterior surface of said panels and positioned between said first decorative rail and said second decorative rail, whereby said decorative components are outwardly flush with said first decorative rail and said second decorative rail and said decorative rails do not interfere with said pinch resistant interface.

2. A sectional door according to claim 1, wherein said decorative components have a thickness equal to said offset depth of said first decorative rail and said second decorative rail from said exterior surfaces.

3. A sectional door according to claim 1, wherein said decorative components are selected from vertical components and diagonal components.

4. A sectional door according to claim 1, wherein said decorative components are attached to said exterior surface by a fastening mechanism.

5. A sectional door according to claim 1, wherein said decorative components are sized to accommodate differences in the coefficients of thermal expansion of the material of said decorative components and the material of said body portion.

6. A sectional door according to claim 1, wherein the length of said decorative components is sufficiently less than the distance between said first decorative rail and said second decorative rail so as to compensate for a greater coefficient of thermal expansion for said decorative components than for said body portion.

7. A sectional door according to claim 1, wherein said panels are selectively formed from metallic materials including steel and aluminum and non-metallic materials including plastic and wood.

8. A sectional door according to claim 1, wherein said panels are formed by saudwiching insulation between said body portion and a backer for said panels of selectively metallic materials including steel and aluminum and non-metallic materials including plastic and wood.

9. A sectional door according to claim 8, wherein said insulation is selectively foam plastic blocks and foam plastic foamed in situ.

10. A sectional door according to claim 1, wherein said projections include a first projection having a concave configuration on one of said panels and a second projection on an adjacent of said panels having a convex configuration, said first projection and said second projection remaining in close proximity during the entirety of the articulation of the sectional door.

11. A sectional door according to claim 10, wherein an upturned lip is attached to the distal end of said first projection and a downturned lip is attached to the distal end of said second projection.

12. A sectional door according to claim 11, wherein said first and said second projections have longitudinal lengths and periodic crimping is provided along said longitudinal lengths.

13. A sectional door according to claim 11, wherein grooves are provided adjacent said first and said second projections, opposing grooves are provided along said upturned and said downturned lips, and strengthening strips are inserted between said grooves and said opposing grooves.

14. A sectional door according to claim 1, wherein said projections include a first projection on one of said panels having a first projecting finger and a second projection having a second projecting finger, whereby said first projecting finger and said second projecting finger remain in dose proximity during the entirety of the articulation of said sectional door.

15. A sectional door according to claim 1, further comprising at least one of said adjacent panels having exterior and interior surfaces, a window pattern, at least one light sheet, and integral clips provided on said interior surface, wherein said integral clips retain said light sheet in position against said window pattern.

16. A sectional door according to claim 1, wherein said first decorative rail and said second decorative rail are formed integrally with said body portion.

17. A sectional door according to claim 1, wherein the number of adjacent panels ranges from two to six.

* * * * *

UNITED STATES PATENT AND TRADEMARK OFFICE

CERTIFICATE OF CORRECTION

PATENT NO. : 7,059,380 B2
APPLICATION NO. : 10/766716
DATED : June 13, 2006
INVENTOR(S) : Bennett, III, Mullett and Mast It is certified that error appears in the above-identified patent and that said Letters Patent is hereby corrected as shown below:

In Column 11, line 10 (Claim 14, line 6) the word "dose" should read --close--.

Signed and Sealed this

First Day of April, 2008

JON W. DUDAS
*Director of the United States Patent and Trademark Office*